US006132145A

United States Patent [19]

Treu et al.

[11] Patent Number: 6,132,145

[45] **Date of Patent: *Oct. 17, 2000**

[54] PUMPSKID FOR SUCTION ANCHORS

[75] Inventors: Johannes Jacobus Treu, Bellville; Thomas M. Fulton, Katy; Francis Wade Abadie, Houston, all of Tex.; Frederick Howard Culver, Covington, La.

[73] Assignee: Aker Marine, Inc., Houston, Tex.

[ * ] Notice: This patent is subject to a terminal disclaimer.

[21] Appl. No.: 09/302,761

[22] Filed: Apr. 30, 1999

Related U.S. Application Data

[63] Continuation of application No. 08/959,931, Oct. 29, 1997, Pat. No. 5,927,904.

[51] Int. Cl.[7] ..... E02D 5/74

[52] U.S. Cl. ..... 405/224; 405/228; 114/296; 114/313

[58] Field of Search ..... 405/224.1, 226, 405/228, 198, 294, 295, 172, 203, 204, 205, 224; 114/294, 295, 296, 312, 313, 333, 322, 323, 324, 325; 285/18, 332.3, 920; 166/338, 341, 344

[56] References Cited

U.S. PATENT DOCUMENTS

| | | | |
|---|---|---|---|
| 2,994,202 | 8/1961 | Knapp et al. | 405/224 |
| 3,263,641 | 8/1966 | Stimson | 405/224 X |
| 3,411,473 | 11/1968 | Mott et al. | 114/296 |
| 3,431,879 | 3/1969 | Westling | 405/224 X |
| 4,024,718 | 5/1977 | Roche et al. | 405/190 |
| 4,164,195 | 8/1979 | Frigeni | 114/322 |
| 4,222,591 | 9/1980 | Haley | 285/920 X |
| 4,318,641 | 3/1982 | Hogervorst | 405/224 |
| 4,432,671 | 2/1984 | Westra et al. | 405/226 |
| 4,439,068 | 3/1984 | Poklandnik | 166/338 X |
| 4,572,304 | 2/1986 | Mahar et al. | 114/296 X |
| 4,575,282 | 3/1986 | Pardue, Sr. et al. | 405/228 |
| 4,601,608 | 7/1986 | Ahlstone | 285/920 X |
| 4,635,728 | 1/1987 | Harrington | 166/341 |
| 4,721,415 | 1/1988 | Shatto | 405/224.1 |
| 4,830,541 | 5/1989 | Shatto | 405/226 |
| 4,940,362 | 7/1990 | Paulshus et al. | 405/224 |
| 5,480,521 | 1/1996 | Snyder, Jr. et al. | 166/338 X |

FOREIGN PATENT DOCUMENTS

| | | | |
|---|---|---|---|
| 610714 | 5/1978 | U.S.S.R. | 114/296 |
| 797955 | 1/1981 | U.S.S.R. | 114/296 |

*Primary Examiner*—David Bagnell
*Assistant Examiner*—Jong-Suk Lee
*Attorney, Agent, or Firm*—John W. Montgomery; Gardere & Wynne, L.L.P.

[57] ABSTRACT

A pumpskid comprises a frame adapted for connection to a remotely operated vehicle for positioning thereby. A male connector mounted on the frame is adapted for engagement with the suction port on a suction anchor. Clamping apparatus is provided for securing the male connector in engagement with the suction port of the suction anchor and thereby clamping the pumpskid in engagement with the suction anchor. A pump mounted on the frame is connected in fluid communication with the male connector by piping sections which include a port open to the surrounding sea. Valves and valve actuators are provided for causing the pump to cause water flow out of or into the suction anchor, as required.

19 Claims, 6 Drawing Sheets

PUMPSKID FOR SUCTION ANCHORS

CROSS REFERENCES TO RELATED APPLICATIONS

This application is a continuation of application Ser. No. 08/959,931 filed on Oct. 29, 1997, now U.S. Pat. No. 5,927,904.

TECHNICAL FIELD

This invention relates to a pumpskid useful in conjunction with a remotely operated vehicle for installing and removing suction anchors in deep water installations.

BACKGROUND AND SUMMARY OF THE INVENTION

U.S. Pat. No. 4,318,641 granted to Hogervorst on Mar. 9, 1982, and assigned to Shell Oil Company discloses a suction anchor. Briefly, a suction anchor comprises a length of steel tubing having a relatively large diameter and a relatively long length, for example, a typical suction anchor might be 12 feet in diameter and 60 feet in length. The suction anchor has an open bottom and a top equipped with structure which allows water to be pumped out of the interior of the suction anchor thereby establishing a pressure differential which causes the suction anchor to penetrate the seafloor. The suction anchor is adapted for subsequent removal from the seafloor by pumping water into the interior thereof.

The Hogervorst '641 Patent discloses in FIGS. 1 and 2 a first pumping apparatus and in FIG. 7 a second apparatus which may be used to effect the flow of water out of or into a suction anchor. Although mentioning structure for clamping the pumping apparatus to the suction anchor, the details of the clamping apparatus are not further disclosed. It is not at all clear from the specification of the Hogervorst '641 Patent that the pumping apparatus described therein can be actuated to effect rapid reversal of the direction of water flow relative to the suction anchor which may be necessary to free the suction anchor from the seafloor in the event that the material into which the suction anchor has been installed has become consolidated around the interior and exterior walls thereof. Also, the apparatus disclosed in FIG. 7 of the Hogervorst '641 Patent for guiding the pumping apparatus downwardly from the surface and into engagement with the suction anchor is not considered adequate for use in deep water installations.

The present invention comprises a pumpskid useful in conjunction with a remotely operated vehicle for installing suction anchors in deep water installations. In accordance with the broader aspects of the invention, the pumpskid is provided with structure for securely clamping the pumpskid in engagement with the suction port of the suction anchor. The pumpskid is provided with remotely operable valving apparatus for causing a pump mounted on the pumpskid to pump water either out of or into the suction anchor as may be required. The valving apparatus may be operated to rapidly reverse the direction of water flow relative to the anchor thereby dislodging a suction anchor which may have become too firmly imbedded in the seafloor.

DETAILED DESCRIPTION

Figure 1:
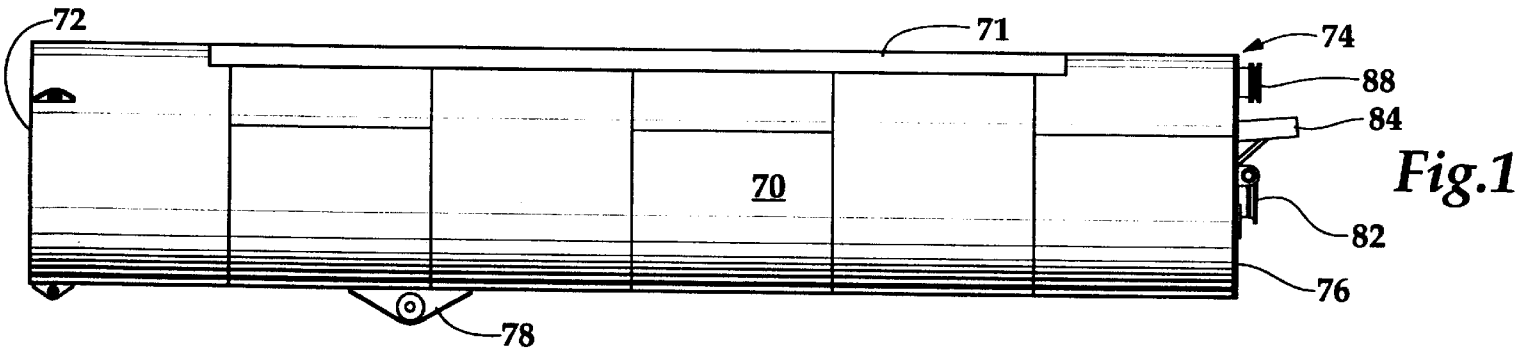
FIG. 1 is a side view of a suction anchor.
Figure 2:
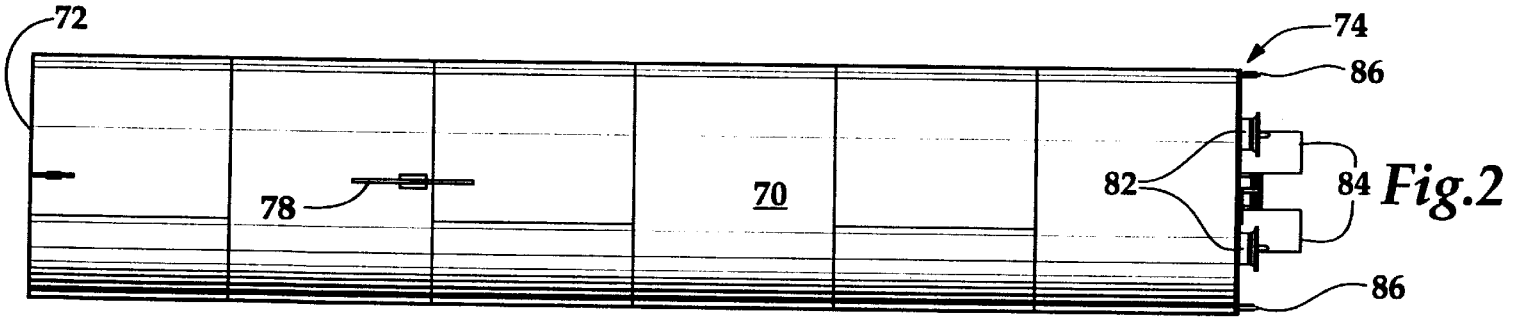
FIG. 2 is a front view of the suction anchor of FIG. 1.
Figure 3:
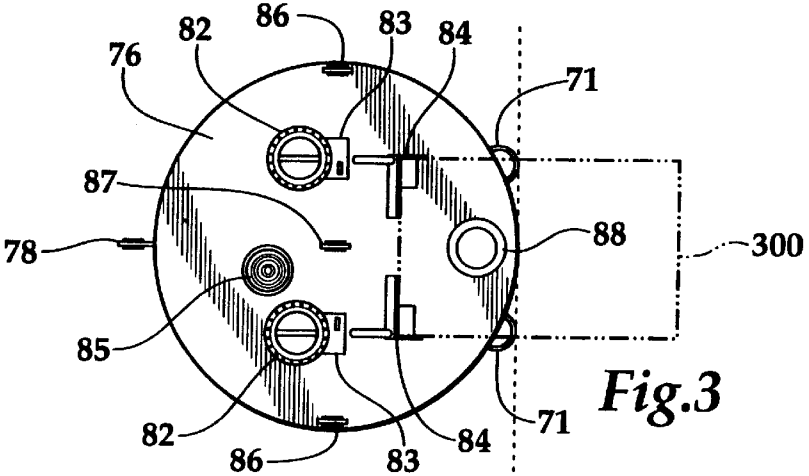
FIG. 3 is a top view of the suction anchor of FIG. 1.
Figure 4:
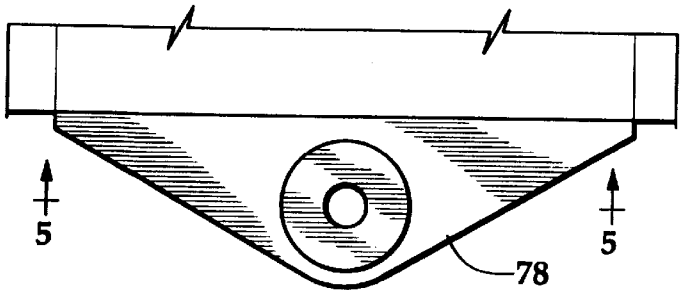
FIG. 4 is an enlargement of a portion of FIG. 1.
Figure 5:
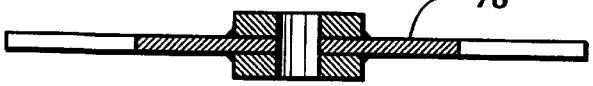
FIG. 5 is a sectional view of the apparatus shown in FIG. 4 taken along the lines 5—5 therein.
Figure 6:
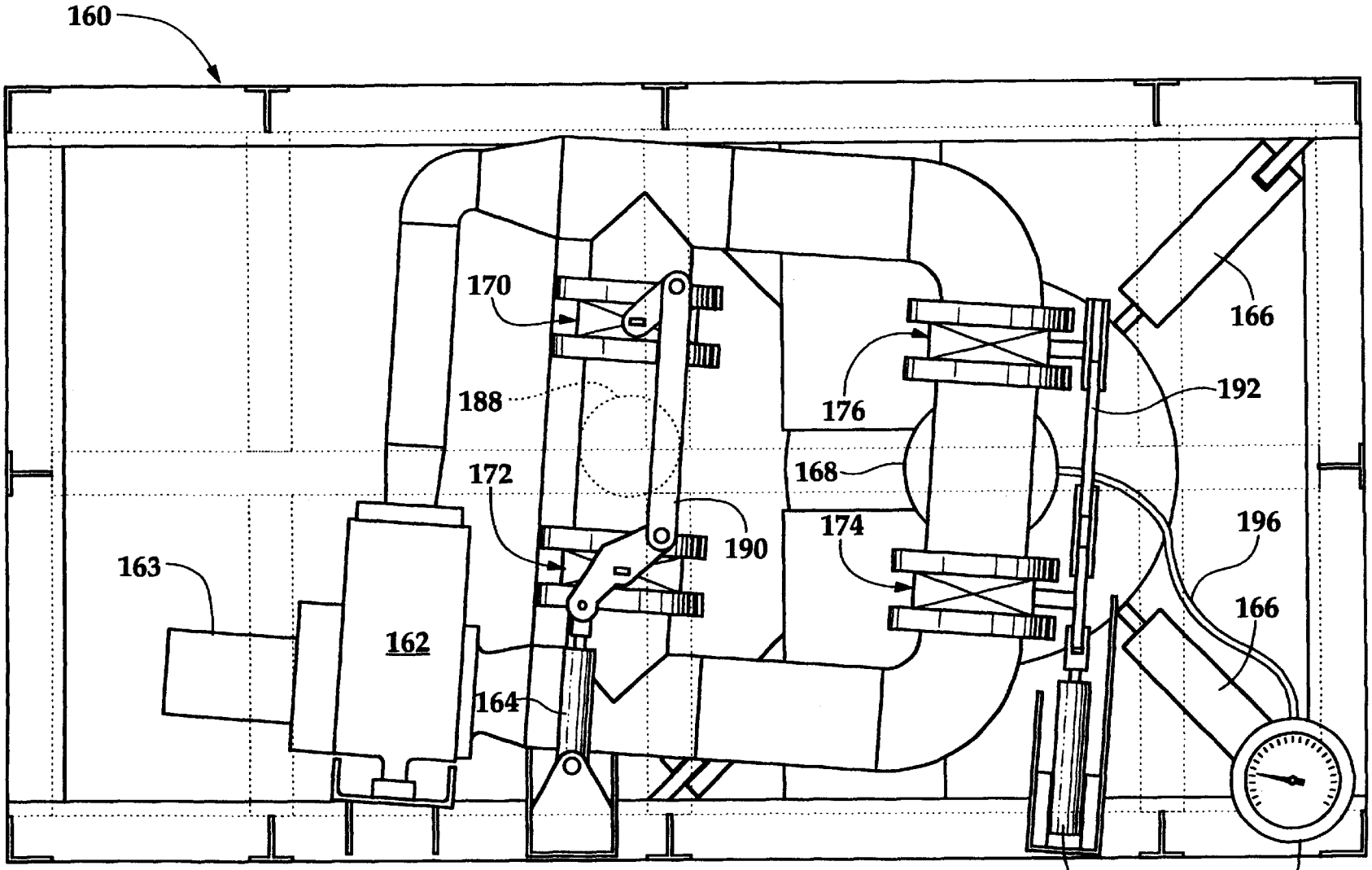
FIG. 6 is a top view of a pumpskid incorporating the present invention.
Figure 7:
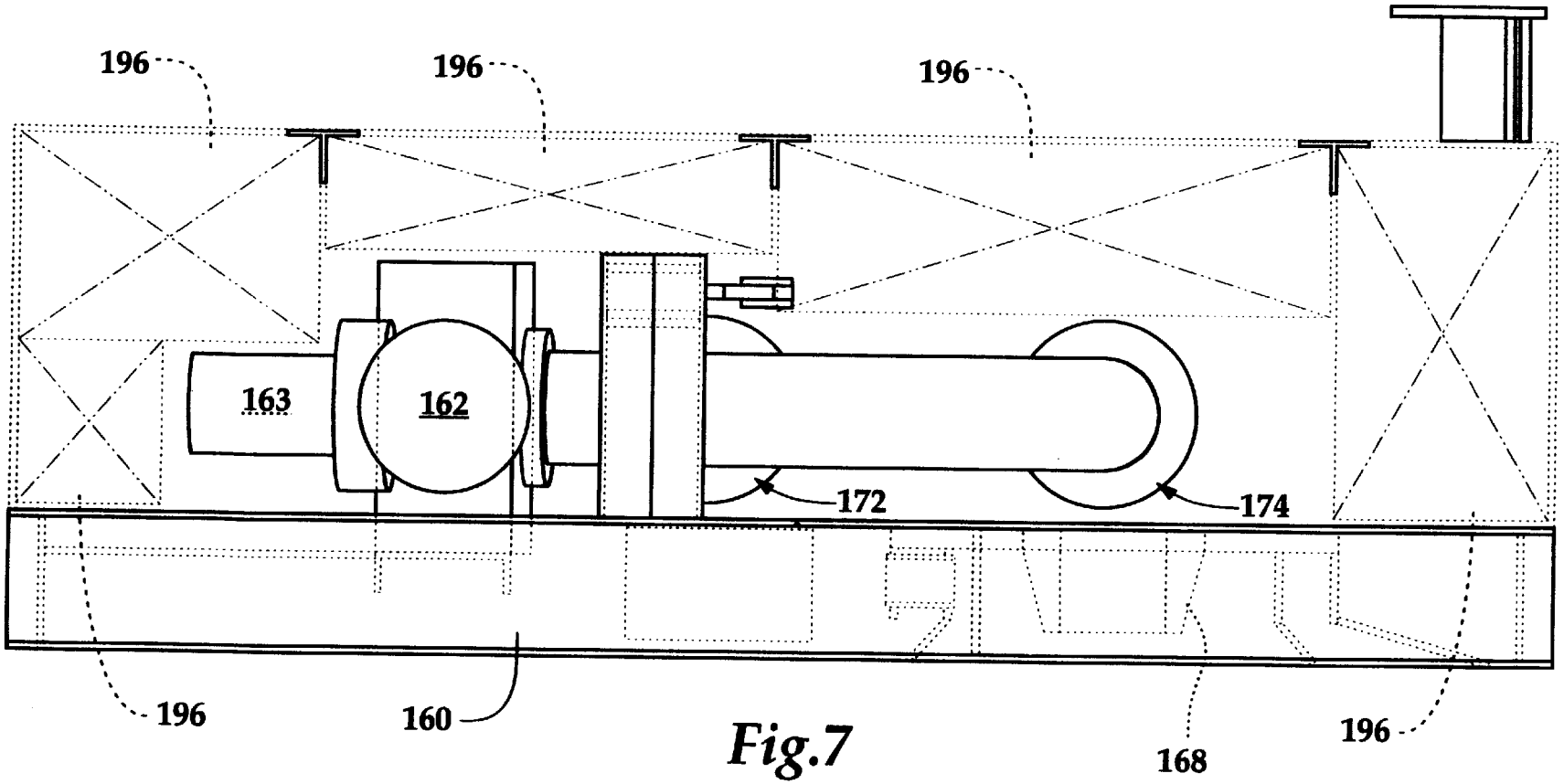
FIG. 7 is a side view of the pumpskid of FIG. 6.

Referring to FIGS. 1 through 5, therein is shown a steel suction anchor 70 useful in the practice of the invention. The suction anchor 70 is a right circular cylinder 12 feet in diameter and 60 feet in length, having a wall thickness of 1.5 inches. Skids 71, which may comprise lengths of angled iron or lengths of pipe cut in half longitudinally, are welded to the cylinder comprising the anchor 70 to prevent it from rolling on the deck of an installation vessel.

The suction anchor 70 is open on the lower end 72 and closed at the upper end 74 by a plate 76. A padeye 78, for receiving a mooring line, is attached on an exterior side of suction anchor 70 approximately 40 feet from the top. The top closure plate 76 on the upper end 74 of suction anchor 70 includes ports 82 which allow water to flow through the closure plate 76 as the anchor 70 heaves up and down during lowering to and retrieval from the seafloor. The ports 82 are opened and closed by worm gear actuators 83 which are in turn operated by a manipulator extending from a remote operation vehicle (ROV) 300 which is located relative to the suction anchor 70 by docking posts 84. ROV 300 may comprise a Raycal SEA LION Mk.II heavy work class ROV having 100 horsepower; however any of the various commercially available ROV's having 75 h.p. or more can be used in the practice of the invention.

Vertical alignment of the anchor 70 is determined using a camera on the ROV 300 which observes a bullseye level 85. The ROV 300 also adjusts the horizontal alignment of the suction anchor 70 by checking the suction anchor's heading with a gyrocompass onboard the ROV. If the horizontal alignment is out of tolerance, the ROV 300 rotates the suction anchor 70 by activating thrusters on the ROV. The placement of the ROV 300 on the outer edge of the closure plate 76 ensures that the ROV's thrusters can apply adequate torque to rotate the suction anchor 70 about its axis.

Padeyes 86 are used to connect the anchor to a recovery bridle. An alternate padeye 87 may be used with a single recovery pendant or with double recovery sling. A suction port 88 having a clamp down hub is engaged by the ROV 300 to effect pumping of water into or out of the anchor 70.

A pumpskid 160 comprising the present invention is shown in FIGS. 6, 7, 8, and 9. The ROV 300 is fitted with the pumpskid 160 which is mounted beneath the ROV. The pumpskid 160 includes a centrifugal pump 162, a hydraulic motor 163 which drives the pump 162, pump manifold valve actuators 164 and 165, and latching actuators 166, all powered and controlled by the hydraulic system of the ROV 300. The pumpskid further includes a male connector 168 for the suction port 88. The male connector is provided with O-ring seals 169 to ensure a water-tight connection with the suction port 80. Valves 170 and 172 are operated by actuator 164 and valves 174 and 176 are operated by actuator 165.

Figure 8:
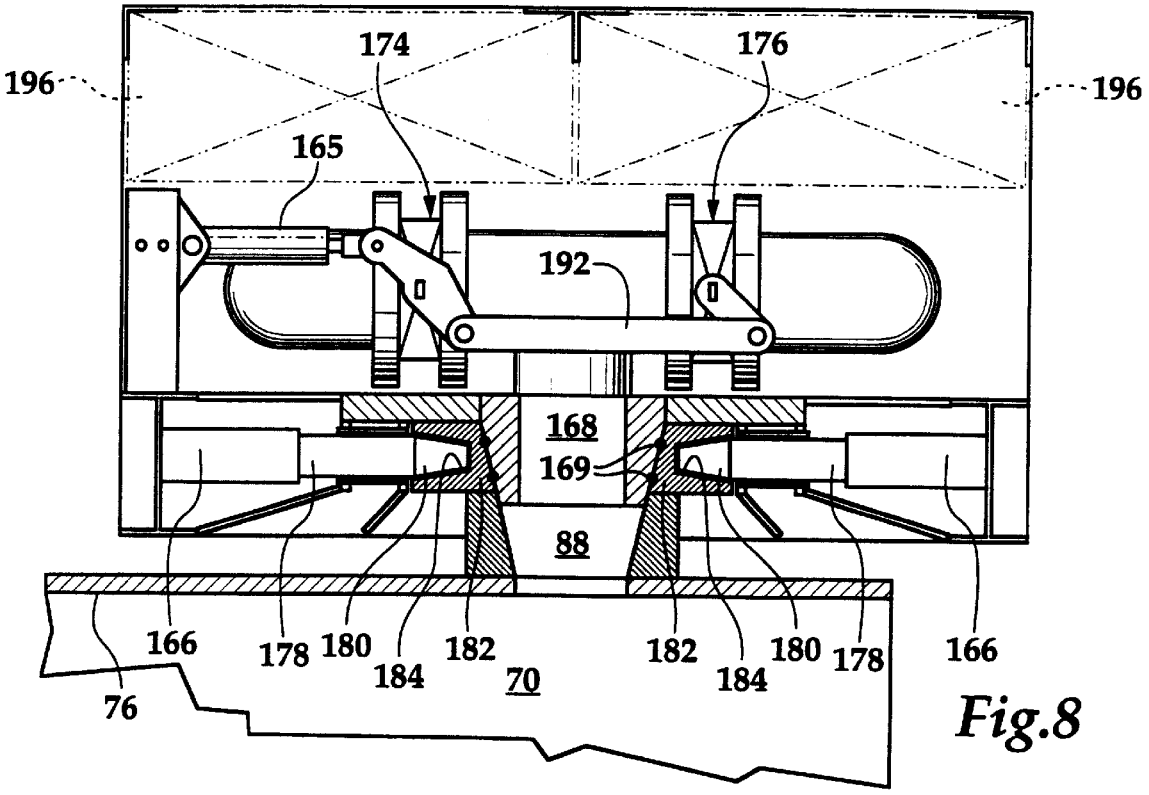
FIG. 8 is an end view of the pumpskid in FIG. 6 in which certain parts have been broken away and more clearly to illustrate certain features of the invention.
Figure 9:
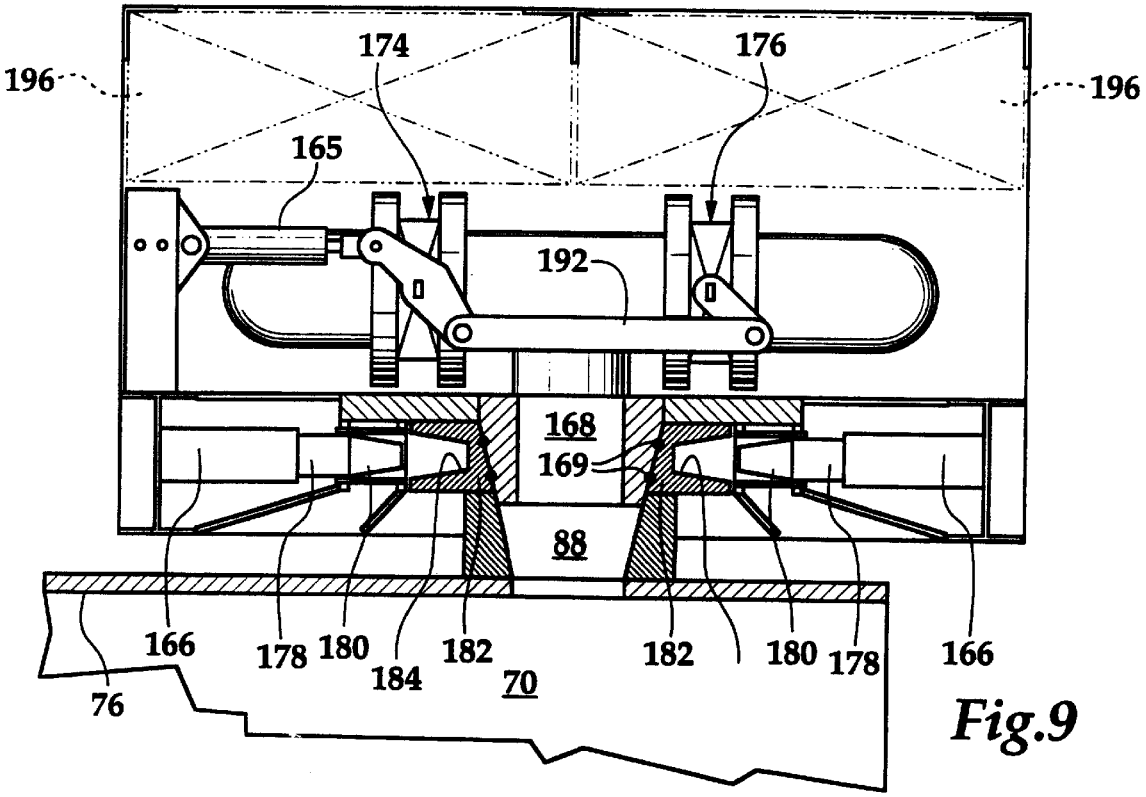
FIG. 9 is a view similar to FIG. 8 showing a different operational condition of the pumpskid of the present invention.
Figure 10:
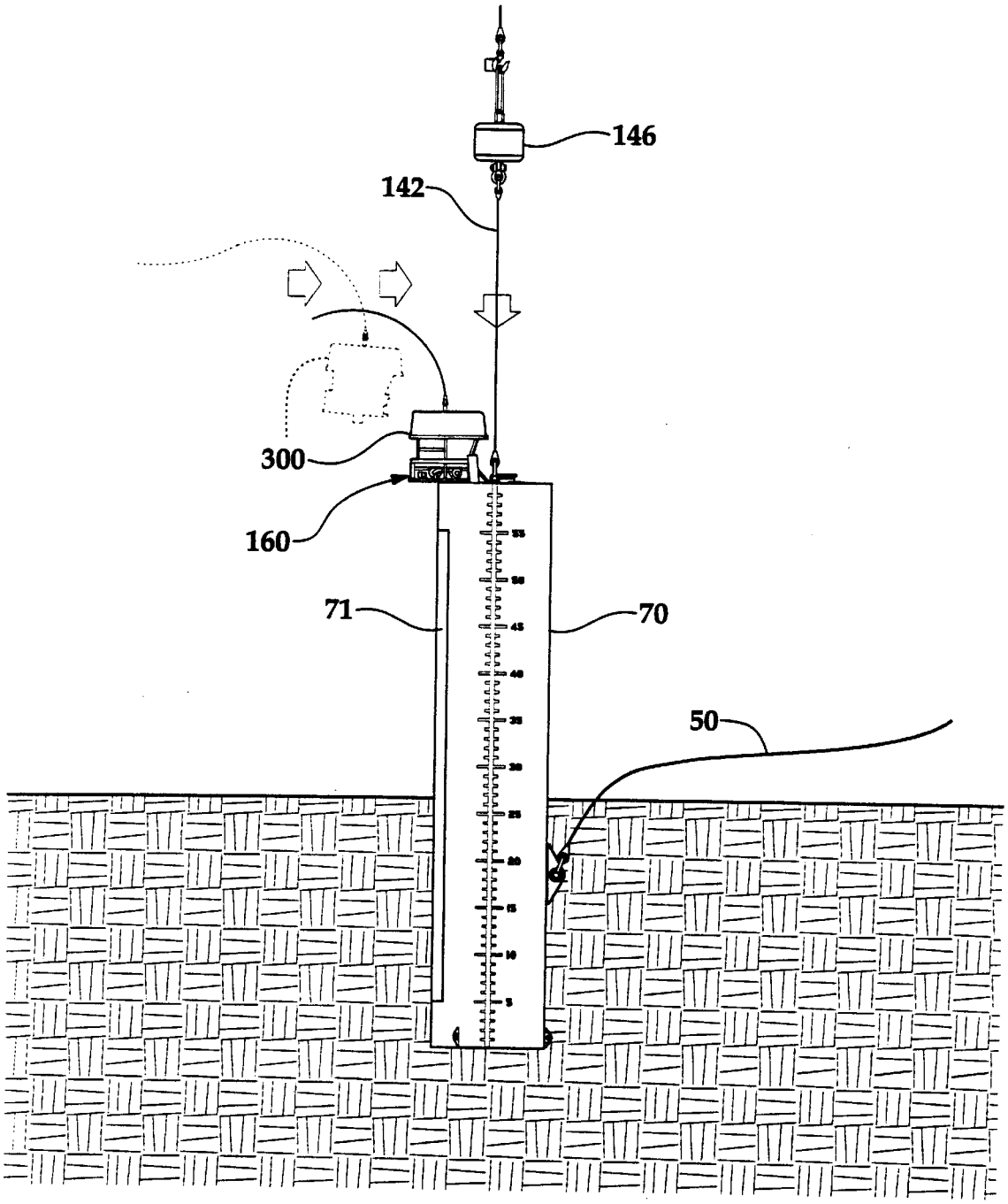
FIG. 10 is a diagrammatic illustration of the utilization of the pumpskid of the present invention.

As is shown in FIGS. 8, 9, and 10, the ROV 300 docks and latches onto the suction anchor 70 and its suction port 88 by engagement of the male connector 168 and by actuating the latching actuators 166. The latching actuators 166 comprise hydraulic cylinders which are actuated from the ROV 300. Each latching actuator 166 has a piston rod 178 extending therefrom. The distal end of each piston rod 178 comprises a truncated cone 180. The suction port 88 of the suction anchor 70 has a clamp down ring 182 which is provided with a tapered circumferential slot 184 adapted for mating engagement with the cones 180 to securely clamp the pumpskid 160 and the ROV 300 in engagement with the suction anchor 70.

After the latching actuators have been operated to engage the cones 180 with the tapered slot 184 to secure the pumpskid 160 to the anchor 70, the ROV closes the ports 82. The pump 162 of the pumpskid 160 is started and pumps water out of the interior of the suction anchor 70, reducing the water pressure inside relative to the outside pressure. This is accomplished by means of actuator 164 which opens valve 170 and closes valve 172 and actuator 165 which opens valve 174 and closes valve 176, thereby causing water to flow through suction port 88, valve 174, pump 162, and valve 170, and then out through a port 188 which is open to the surrounding sea. As will be understood, the mechanical linkage 190 extending between the actuator 164, the valve 170, and the valve 172 assures that whenever valve 170 is open valve 172 is closed, and vice versa. Likewise, the linkage 192 between actuator 162, valve 174, and valve 176 assures that whenever valve 174 is open valve 176 is closed and vice versa.

The differential pressure under the action of pump 162 acts as a downward force on the top of the suction anchor 70 pushing the suction anchor further into the seafloor to the desired penetration depth. When the desired penetration has been reached, as determined from a depth monitoring system on the ROV 300, the ROV disconnects from the top of the suction anchor 70. This is accomplished by operation of the latching actuators to withdraw the cones 180 from the tapered slot 184. Next the ROV checks the suction anchor penetration by reading the penetration marks at the mudline. When the suction anchor 70 penetration is found to be within tolerance, the ROV 300 closes the suction port 88 so that all openings in the top of the suction anchor are closed. The ROV 300 then disconnects the lowering line from the recovery buoy 146 and is retrieved to the surface.

Figure 11:
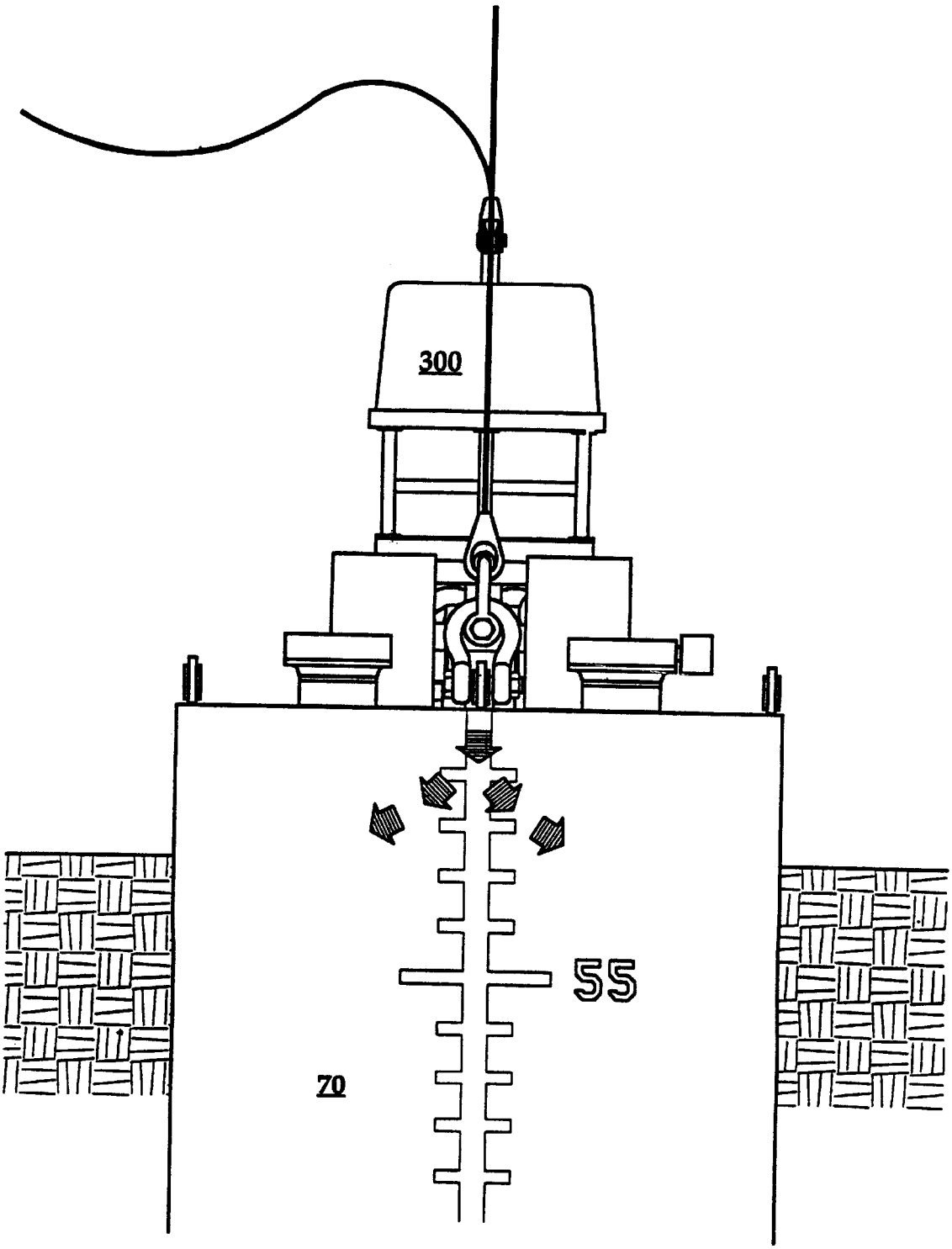
FIG. 11 is an enlarged partial side view of the apparatus shown in FIG. 10.

Whenever removal of the suction anchor 70 is desired, the ROV 300 docks onto the suction anchor top and latches onto the suction port 88. This is accomplished by operating latching actuators 166 to force the cones 180 into the tapered slot 184. As is shown in FIG. 11, the ROV 300 pumps water into the interior of the suction anchor by means of the pump 162. This is accomplished by operating the actuators 164 and 165 to open valve 176, open valve 172, close valve 174, and close valve 170, thereby causing water to flow through port 188, valve 172, pump 162, valve 176 and port 88 into anchor 70.

Due to the pump 162, the water pressure inside becomes greater than the outside water pressure, and the differential pressure results in an upwards force on the suction anchor top. The upwards force, and the pull on the recovery line pulls the suction anchor out of the seafloor. If too much pump pressure is required to pull the suction anchor 70 out of the seafloor, due to too much consolidation of th soil around and inside the suction anchor, the water flow direction from the pump 162 can be reversed instantaneously by changing the positions of valve actuators 164 and 165. By rapidly changing the water flow direction from pumping in to pumping out, the suction anchor 70 will be alternately pulled out and pushed in. When this is done for some time, the soil in contact with the suction anchor cylinder will liquefy, making it easier to pump and pull the suction anchor out off the soil. Suction anchor 70 is raised to the surface by a recovery line and is loaded on an installation vessel using the rise line 50.

The pumpskid 160 is provided with a differential pressure gauge 194 which is connected to the male connector 168 by a pressure line 196. The pressure line 194 indicates the difference in the pressure of the water within the connector 168 with respect to the pressure of the water outside of the suction anchor. The ROV 300 monitors the gauge 194 during suction anchor installation and removal operations to assure that the differential pressure between the inside and the outside of the suction anchor remains within predetermined limits.

The water pumping rate can be adjusted from the ROV 300 by controlling the rate of flow of pressurized hydraulic fluid to the hydraulic motor 163. Reduction in the water flow rate may be required if either the suction anchor penetration rate, or the suction anchor withdrawal rate, or the differential pressure between the interior and the exterior of the suction anchor is too high.

The pumpskid 160 is fitted with syntactic foam buoyancy elements 196 designed for the maximum operating water depth. The buoyancy elements 196 ensure that the pumpskid 160 is slightly buoyant when submerged.

Although preferred and alternative embodiments of the invention have been illustrated in the accompanying Drawings and described in the foregoing Detailed Description, it will be understood that the invention is not limited to the embodiments disclosed, but is capable of numerous rearrangements and substitutions of parts and elements without departing from the spirit of the invention.

What is claimed is:

1. A pumpskid for use in installing and removing a suction anchor from the seafloor comprising:

a piping system having a first port and a second port, the first port operably connectable to the suction anchor, the second port open to the surrounding sea;

a pump operably disposed within the piping system between the first port and the second port; and a valving system disposed within the piping system having an installation configuration and a removal configuration, in the installation configuration, the valving system providing a path for water flow into the first port from the suction anchor, through the pump and out of the second port into the surrounding sea, in the removal configuration, the valving system providing a path for water to flow into the second port from the surrounding sea, through the pump and out of the first port into the suction anchor.

2. The pumpskid as recited in claim 1 further including a hydraulic motor operably coupled to the pump for driving the pump.

3. The pumpskid as recited in claim 1 wherein the first port further includes a male connector adapted for engagement with a suction port of the suction anchor.

4. The pumpskid as recited in claim 3 further comprising at least one O-ring extending around the periphery of the male connector for engagement with the suction port to form a water-tight seal.

5. The pumpskid as recited in claim 1 further comprising a latching mechanism for securing the first port to the suction anchor.

6. The pumpskid as recited in claim 1 wherein the latching mechanism comprises a plurality of latching piston rods and a plurality of hydraulic actuators each for selective actuation to extend the latching piston rods into engagement with a suction port of the suction anchor thereby securing the first port in engagement therewith and for retraction to disengage the first port from the suction port.

7. The pumpskid as recited in claim 1 wherein the valving system further comprises first and second pairs of valves, the first pair of valves including an installation valve and a removal valve, the second pair of valves including an installation valve and a removal valve.

8. The pumpskid as recited in claim 7 wherein the valving system is in the installation configuration when the installation valves of the first and second pairs of valves are open and the removal valves of the first and second pairs of valves are closed.

9. The pumpskid as recited in claim 7 wherein the valving system is in the removal configuration when the removal valves of the first and second pairs of valves are open and the installation valves of the first and second pairs of valves are closed.

10. The pumpskid as recited in claim 7 further comprising a linkages between the installation valve and the removal valve of the first pair of the valves that opens the installation valve of the first pair of the valves while closing the removal valve of the first pair of valves and closes the installation valve of the first pair of valves while opening the removal valve of the first pair of valves.

11. The pumpskid as recited in claim 7 further comprising a linkage between the installation valve and the removal valve of the second pair of valves that opens the installation valve of the second pair of valves while closing the removal valve of the second pair of valves and closes the installation valve of the second pair of valves while opening the removal valve of the second pair of valves.

12. A pumpskid for use in installing and removing a suction anchor from the seafloor comprising:

a piping system having first port and a second port, the first port operably connectable to the suction anchor, the second port open to the surrounding sea;

a pump operably disposed within the piping system between the first port and the second port; and a valving system disposed within the piping system having an installation configuration and a removal configuration, the valving system including first and second pairs of valves, the first pair of valves including an installation valve and a removal valve, the second pair of valves including an installation valve and a removal valve, in the installation configuration, the installation valves of the first and second pairs of valves are open and the removal valves of the first and second pairs of valves are closed providing a path for water flow into the first port from the suction anchor, through the pump and out of the second port into the surrounding sea, in the removal configuration, the removal valves of the first and second pairs of valves are open and the installation valves of the first and second pairs of valves are closed providing a path for water to flow into the second port from the surrounding sea, through the pump and out of the first port into the suction anchor.

13. The pumpskid as recited in claim 12 further including a hydraulic motor operably coupled to the pump for driving the pump.

14. The pumpskid as recited in claim 12 wherein the first port further includes a male connector adapted for engagement with a suction port of the suction anchor.

15. The pumpskid as recited in claim 14 further comprising at lease one O-ring extending around the periphery of the male connector for engagement with the suction port to form a water-tight seal.

16. The pumpskid as recited in claim 12 further comprising a latching mechanism for securing the first port to the suction anchor.

17. The pumpskid as recited in claim 16 wherein the latching mechanism comprises a plurality of latching piston rods and a plurality of hydraulic actuators each for selective actuation to extend the latching piston rods into engagement with a suction port of the suction anchor thereby securing the first port in engagement therewith and for retraction to disengage the first port from the suction port.

18. The pumpskid as recited in claim 12 further comprising a linkage between the installation valve and the removal valve of the first pair of the valves that opens the installation valve of the first pair of valves while closing the removal valve of the fist pair of valves and closes the installation valve of the fist pair of valves while opening the removal valve of the first pair of valves.

19. The pumpskid as recited in claim 12 further comprising a linkage between the installation valve and the removal valve of the second pair of valves that opens the installation valve of the second pair of valves while closing the removal valve of the second pair of valves and closes the installation valve of the second pair of valves while opening the removal valve of the second pair valves.

* * * * *